US007183475B2

(12) United States Patent
Van Halen

(10) Patent No.: US 7,183,475 B2
(45) Date of Patent: Feb. 27, 2007

(54) STRINGED INSTRUMENT WITH ADJUSTABLE STRING TENSION CONTROL

(75) Inventor: Edward Van Halen, Los Angeles, CA (US)

(73) Assignee: E.L.V.H., Inc., Burbank, CA (US)

( * ) Notice: Subject to any disclaimer, the term of this patent is extended or adjusted under 35 U.S.C. 154(b) by 0 days.

(21) Appl. No.: 10/370,351

(22) Filed: Feb. 18, 2003

(65) Prior Publication Data

US 2004/0159203 A1 Aug. 19, 2004

(51) Int. Cl.
*G10D 3/04* (2006.01)

(52) U.S. Cl. ..... 84/298

(58) Field of Classification Search ..... 84/297 R, 84/313, 298, 299, 307, 312 R
See application file for complete search history.

(56) References Cited

U.S. PATENT DOCUMENTS

| | | | | | |
|---|---|---|---|---|---|
| 3,142,221 | A | * | 7/1964 | Boyd | 84/313 |
| 4,535,670 | A | | 8/1985 | Borisoff | 84/312 |
| 4,610,190 | A | * | 9/1986 | Maloney | 84/312 R |
| 4,686,883 | A | | 8/1987 | Piche et al. | 84/313 |
| 5,127,298 | A | * | 7/1992 | Snape et al. | 84/313 |
| 5,542,330 | A | | 8/1996 | Borisoff | 84/298 |
| 5,760,321 | A | * | 6/1998 | Seabert | 84/312 R |
| 5,907,114 | A | * | 5/1999 | Culver | 84/313 |

OTHER PUBLICATIONS

"The tone and volume controls," The electric guitar: analysis of components, undated, 3 pages.
"Schaller Floyd Rose Tremolo Diagram," Guitar Body Schaller Floyd Tremolo, undated, 2 pages.
"Schaller 456 Fine Tuning Stud Mount Bridge Diagram," Guitar Body 456 Schaller Bridge, undated, 1 page.
Van Halen, Eddie, "Finally . . . an easy way to drop from E down to D and back, without unclamping," undated 2 pages.
"Ibanez Instruction Manual," undated, 2 pages.
Brochure from Hipshot Products, Inc., Jan. 2002.

* cited by examiner

*Primary Examiner*—Kimberly Lockett
(74) *Attorney, Agent, or Firm*—Irell & Manella LLP

(57) ABSTRACT

A tension adjustment mechanism for a stringed musical instrument suitable for use on a tailpiece assembly comprises a pivoting member (such as a string receptor), an adjustable stop, and a lever handle engaged with the pivoting member. The pivoting member preferably has a post for securely receiving an end of a string and an elongate arm. Placement of the handle in a first position preferably causes the adjustable stop to engage and depress the elongate arm of the pivoting member, thereby increasing tension on the string. Placement of the handle in a second position preferably causes the adjustable stop to disengage the elongate arm of the pivoting member, thereby allowing the pivoting member to return to its original position, and decreasing tension on the string. A fine tuning adjustment may be included in the tailpiece assembly. The adjustable stop and/or fine tuning adjustment may comprise adjustable screws.

28 Claims, 5 Drawing Sheets

FIG. 6A
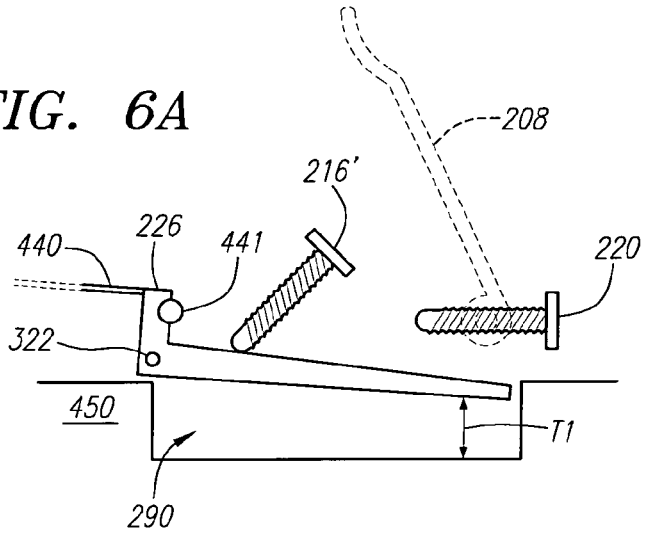
FIG. 6B
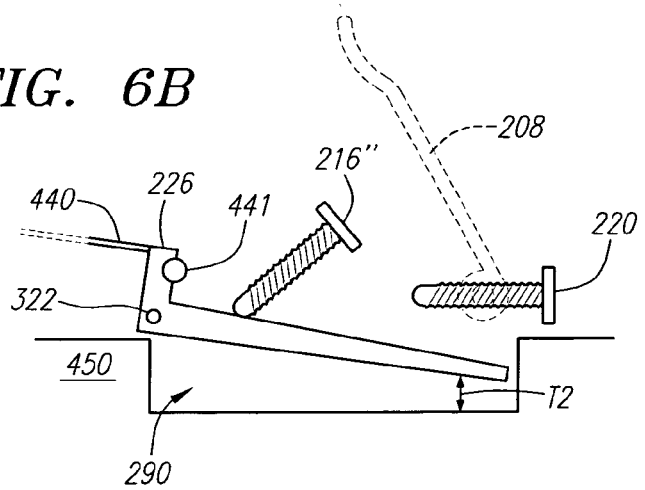
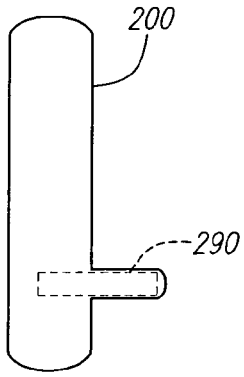
FIG. 7

STRINGED INSTRUMENT WITH ADJUSTABLE STRING TENSION CONTROL

BACKGROUND OF THE INVENTION

1. Field of the Invention

The field of the invention generally pertains to stringed instruments and, more specifically, to an adjustable string tension control for a stringed instrument.

2. Background

Stringed instruments, such as guitars, generally have multiple strings which are anchored at one end to a tailpiece or bridge assembly and at the other end to a number of tuning pegs. Rotation or adjustment of the tuning pegs increases the tension of the strings and thus increases the pitch produced by the strings. Typically the strings of an instrument are tuned prior to a performance or session, with the intent usually being for the strings to remain in their tuned settings for the duration of the performance or session.

Nevertheless, musicians occasionally desire to alter the tuning or tensioning of musical instrument strings during a performance or rendition in order to, for example, achieve a different range of notes, different sound qualities and feel, or various musical effects. During live performances or renditions, however, it can be difficult, cumbersome, and imprecise to use conventional tuning knobs to attempt to adjust the tuning or tension of the strings. One technique that has been developed for varying the tension of guitar strings that does not involve the guitar's tuning keys is known as a tremolo bar. A tremolo bar connects to the guitar bridge and is manipulated by the musician to increase or decrease the tension on the guitar strings (typically all of the strings simultaneously). When the musician releases the tremolo bar, the strings return to their original tensions.

Other examples of mechanisms for altering the tension of strings are disclosed, for example, in U.S. Pat. Nos. 4,535,670 and 5,542,330.

Conventional techniques for adjusting the tension of musical instrument strings may suffer from various drawbacks. For example, with a tremolo bar, the shift in the tension or tone of a string depends upon the amount of physical displacement of the bar, and is therefore relatively imprecise. Also, the tremolo bar generally affects all of the strings simultaneously. In various other techniques, the amount of potential change in the tension of a string may be limited. Also, the mechanism for adjusting the tension of the string may be inconvenient or difficult to use, particularly during live performances or other renditions.

SUMMARY OF THE INVENTION

The invention in one aspect is generally directed to a stringed instrument with an adjustable string tension control.

In one embodiment, a tension adjustment mechanism for a stringed musical instrument comprises a pivoting member, an adjustable stop, and a handle adapted for manual actuation between a first position and a second position. The pivoting member is preferably configured to engage an end of a string (by, e.g., a post), and includes an elongate arm. Placement of the handle in the first position causes a contact member to engage and depress the elongate arm of the pivoting member, thereby increasing tension on the string, while placement of the handle in the second position causes the contact member to disengage the elongate arm of the pivoting member, thereby allowing the pivoting member to come to rest against the adjustable stop and decreasing tension on the string.

In a particular embodiment, a tailpiece (which may be a combined bridge/tailpiece) for a stringed musical instrument includes a hinged member or string receptor having a post for securing a first end of a string and an elongate lever arm mechanically engaged with the post. The hinged member or string receptor is pivotally mounted to the tailpiece (or combined bridge/tailpiece) frame. The elongate lever arm can be depressed into a cutout beneath plane of the instrument surface. A pivotable lever handle controls motion of the hinged member or string receptor by either causing a first adjustable stop (e.g., a first adjustable screw) to engage the elongate lever arm (thus depressing it), resulting in increased string tension, or else causing the first adjustable stop to disengage, thereby allowing the elongate lever arm to be raised by the natural tension of the string and allowing it to come to rest against a second adjustable stop (e.g., a second adjustable screw), resulting in decreased string tension. The first adjustable stop controls the normal playing pitch (and fine tuning), and the second adjustable stop controls the drop-down pitch.

Further embodiments, variations and enhancements are also disclosed herein.

BRIEF DESCRIPTION OF THE DRAWINGS

FIGS. 6A and 6B are cut-away side view diagrams illustrating examples of operation of the tension adjustment screw illustrated in FIGS. 4A and 4B.

FIG. 7 is a top-view diagram of a cut-out as may be used, for example, in connection with the assembly illustrated in FIGS. 2A and 2B.

DETAILED DESCRIPTION OF PREFERRED EMBODIMENTS

Figure 1:
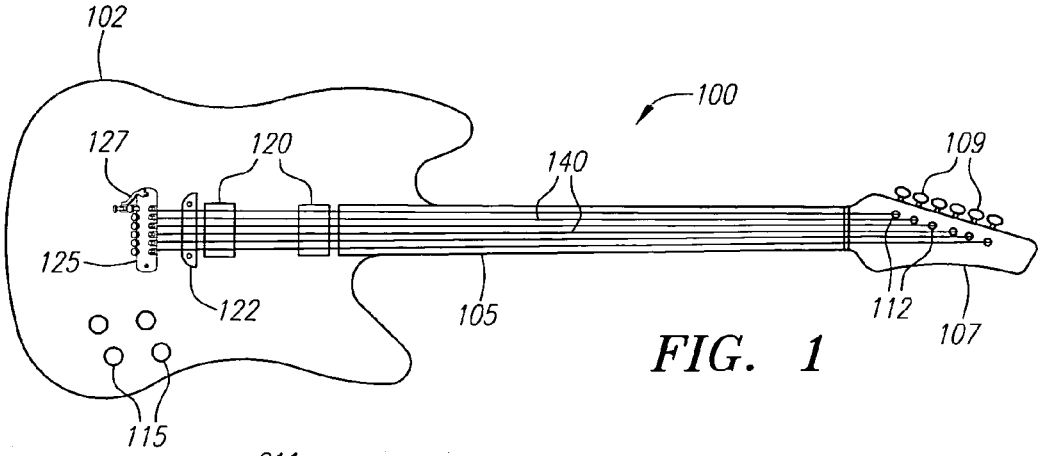
FIG. 1 is a diagram of a guitar illustrating certain features of interest.

FIG. 1 is a generalized diagram of a guitar 100 illustrating certain features of interest. In the example shown in FIG. 1, the guitar 100 is an electric guitar. The guitar 100 includes a body 102 that is generally solid in nature, but alternatively may be semi-hollow or hollow. The body 102 of the guitar 100 is connected to a neck 105, which is terminated by a headstock 107. Tuning pegs 112 are attached to the headstock 107 and function to secure a set of strings 140 as is well known in the art. Rotation of the tuning pegs 112 may be accomplished by manually twisting individual tuning keys (typically in the form of rotatable knobs or keys) 109 to increase or decrease the tension on the individual strings 140, thus allowing the strings 140 to be tuned to selected notes.

A tailpiece 125 is anchored or otherwise attached to the body 102 of the guitar 100, and secures the opposite ends of the strings 140. A bridge 122 for engaging the strings is anchored or otherwise attached to the body 102 of the guitar 100 along the path of the strings 140. The bridge 122 may be of any conventional or other design, such as, for example, a Tune-o-matic style bridge. The bridge 122 may comprise individual adjustable saddles that can, for example, be moved forward or backward to modulate the intonation of each individual string, and moved higher or lower to adjust the height (or "action") of the individual strings relative to the neck 105. Alternatively, the bridge 122 may comprise a single notched or grooved crossbar that can be moved forward or backward, or raised or lowered, to collectively adjust the intonation and relative height of all of the strings 140 simultaneously. In any variation, the bridge 122 may be combined with the tailpiece 125 on a single assembly or plate. The tailpiece 125 and bridge 122 may be constructed from any suitable material, but will typically be formed of a steel alloy or other metallic material.

The guitar 100 also includes one or more pickups 120 which, according to well known techniques, detect sound vibrations of the strings 140 and transform the vibrations into electrical signals which can be output for amplification and subject to various effects processing. Various tone and volume control knobs 115 regulate the sound tone and output volume of the guitar 100.

Figure 2A:
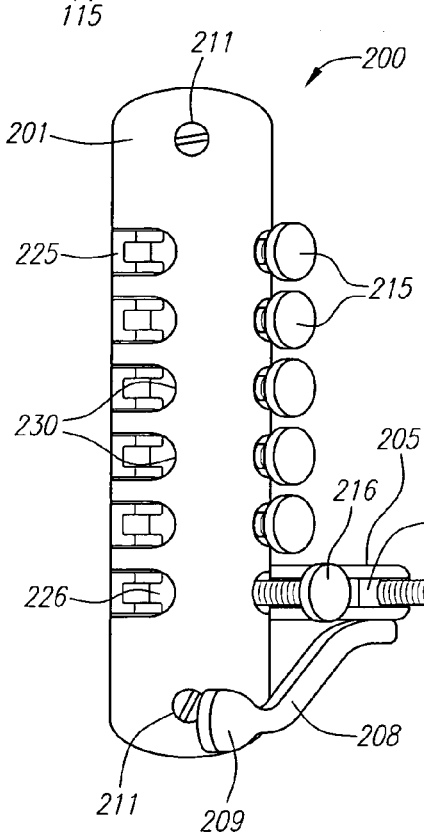
FIGS. 2A and 2B are diagrams of an assembly including a string tension adjustment mechanism in accordance with one embodiment as disclosed herein.
Figure 2B:
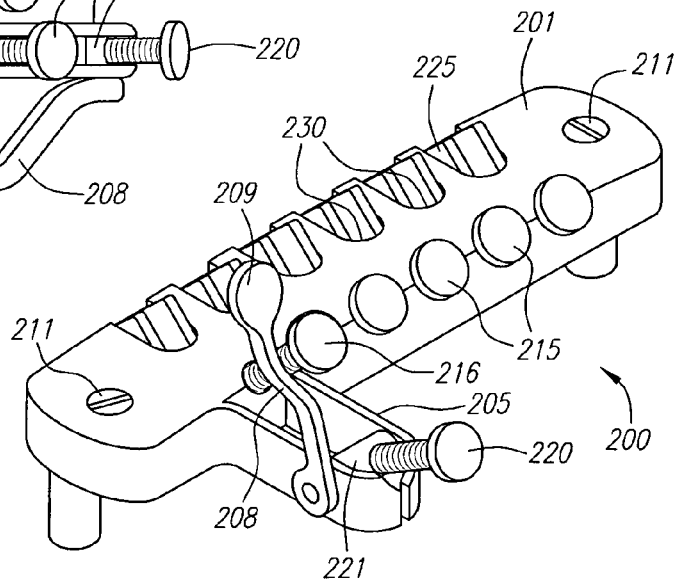

In the example of FIG. 1, the tailpiece 125 includes a lever 127 that can be used to adjust the tension of a guitar string 140 (or, alternatively, multiple guitar strings 140). Further details of the particular tailpiece 125 shown in FIG. 1 are illustrated in FIGS. 2A and 2B, which are reverse-angle diagrams of a tailpiece assembly 200 including a string tension adjustment mechanism in accordance with one embodiment as disclosed herein. FIG. 2A shows a top-view of the tailpiece assembly 200, while FIG. 2B shows an oblique view thereof. As depicted in FIGS. 2A and 2B, the tailpiece assembly 200 includes a body portion 201 having a plurality of cut-outs 230 for receiving the knobbed or balled ends of the individual strings 140. In each of cut-outs 230 resides a string receptor 225 (and/or 226). The string receptors 225, 226 each generally comprise a hooked or forked member for engaging the knobbed or balled end of a string 140. The string receptors 225, 226 are preferably adjustable and may, for example, be hinged to allow fine tuning adjustment in conjunction with an adjustable stop (such as a screw), with the string tension providing the counter-force to the adjustable stop. FIG. 3B illustrates a particular example of a string receptor 226 utilized on a tension-adjustable string 140, and will be described in more detail later herein. A set of fine-tuning screws 215 (and/or 220), one for each string 140, may be provided in order to allow fine tuning of the individual strings 140. The tailpiece assembly 200 may be secured to the guitar 100 by screws 211.

As further illustrated in FIGS. 2A and 2B, the tailpiece assembly 200 may have an extension 205 which is configured in part to enclose and/or provide structure for a string tension adjustment mechanism. In the present example, the extension 205 is associated with what would conventionally be the "low-E" string of a 6-string guitar, but it may alternatively be used in connection with the "high-E" string, or any other string, of the instrument. As further noted later herein, the tension adjustment mechanism may be associated with more than one string 140, or multiple tension adjustment mechanisms may be included in a single tailpiece assembly.

In the present example, the extension 205 comprises a pair of sidewalls between which is positioned a rotatable cylindrical rod 221. The cylindrical rod 221 is attached to a lever handle 208 which, in the instant example, has a curved arm terminating in an enlarged finger pad 209. The cylindrical rod 221 preferably has a threaded hole bored through its midsection, through which a fine tuning screw 220 is placed. The fine tuning screw 220 serves a similar purpose to the other fine tuning screws 215, but is placed further back therefrom to provide room for a tension adjustment screw 216. The tension adjustment screw 216 in this example is lined up in generally along the same axis as the fine-tuning screws 215 for the other (non-tension-adjustable) strings 140. The tension adjustment screw 216 may, but need not, be longer than the fine-tuning screws 215 used on the non-tension-adjustable strings 140, in order to increase accessibility in certain embodiments. As will be described further herein, the tension adjustment screw 216 preferably dictates the amount by which the tension is reduced (and thus the amount by which the pitch drops) for an affected string 140.

Figure 4A:
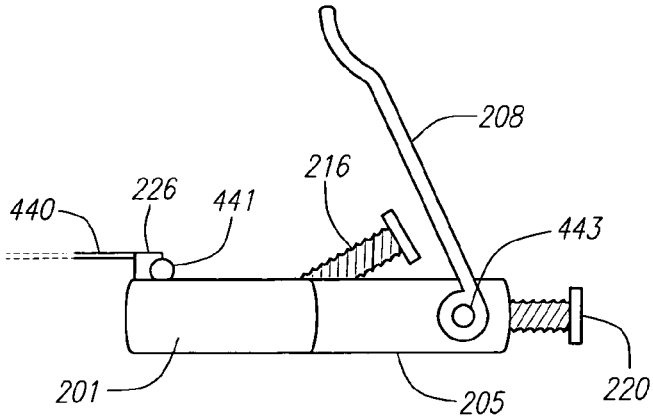
FIGS. 4A and 4B are side view diagrams of the assembly shown in FIGS. 2A and 2B, illustrating different lever positions according to one example for adjusting the tension of a string.
Figure 4B:
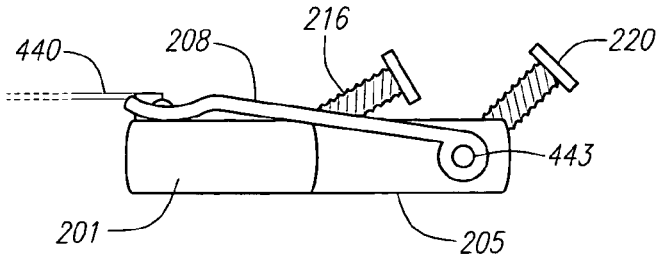

In a preferred embodiment, tension adjustment of a string 140 is carried out by movement of the lever handle 208. FIGS. 4A and 4B are side view diagrams of the tailpiece assembly 200 shown in FIGS. 2A and 2B, illustrating different lever positions according to one example for adjusting the tension of a string. FIG. 4B illustrates the lever handle 208 in the "normal" playing position, which is generally parallel with the body surface of the guitar and depressed against the top of the body portion 201 of the tailpiece assembly 200. FIG. 4A illustrates the lever handle 208 after being rotated to an upright or partially upright position, which, for reasons explained hereinafter, results in decreased tension on the string 440 and a drop in pitch generated from the string 440. Also illustrated in FIGS. 4A and 4B are the knobbed or balled end 441 of the string 441 being engaged by the string receptor 226, and an end portion 443 of the cylindrical rod 221 (or, alternatively, a cylindrical insert which moves in tandem with the cylindrical rod 221).

Figure 5A:
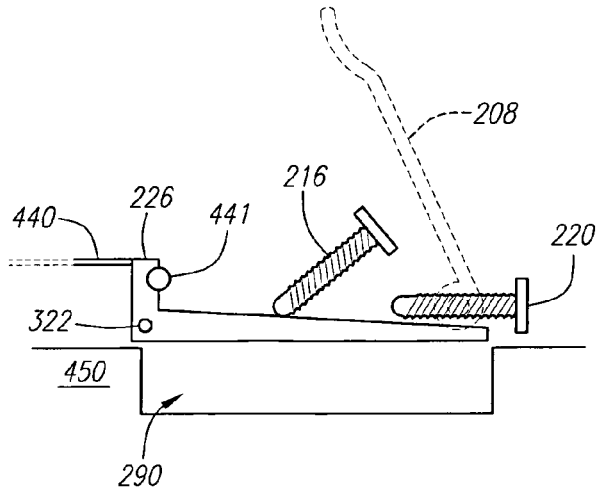
FIGS. 5A, 5B and 5C are cut-away side view diagrams of the assembly shown in FIGS. 2A and 2B, illustrating operation according to one embodiment as disclosed herein.
Figure 5B:
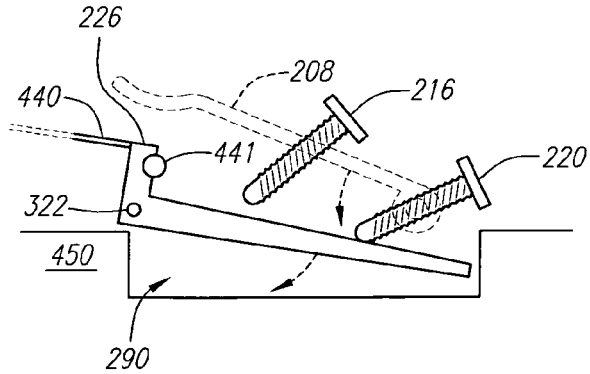
Figure 5C:
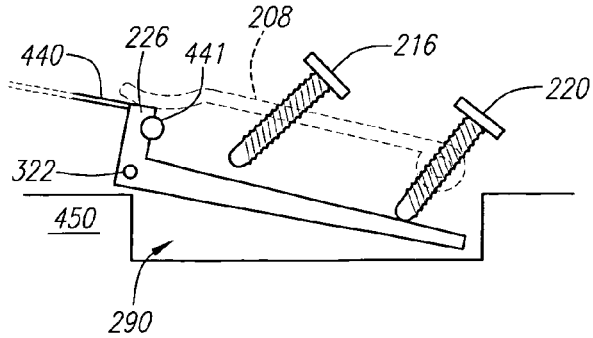

An example of operation of the string tensioning adjustment of the tailpiece assembly of FIGS. 2A and 2B is illustrated in FIGS. 5A, 5B and 5C, which are side view cut-away diagrams of the assembly shown in FIGS. 2A and 2B according to one embodiment as disclosed herein. In FIGS. 5A, 5B and 5C is shown a side view of string receptor 226 relative to fine-tuning screw 220 and tension adjustment screw 216. The knobbed or balled end 441 of a string 440 is engaged with the forked or hooked end of the string receptor 226. As more fully described below, the string receptor 226 is pivotable, and rotation of the string receptor increases or decreases the tension on the string 440 by, among other things, pulling back on or slightly releasing the knobbed or balled end 441 of the string 440.

Figure 3A:
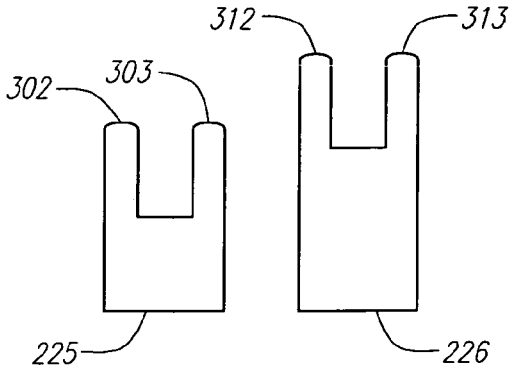
FIG. 3A is a front view diagram comparing string receptors for a tension-adjustable string and a non-tension-adjustable string in accordance with the assembly illustrated in FIGS. 2A and 2B.
Figure 3B:
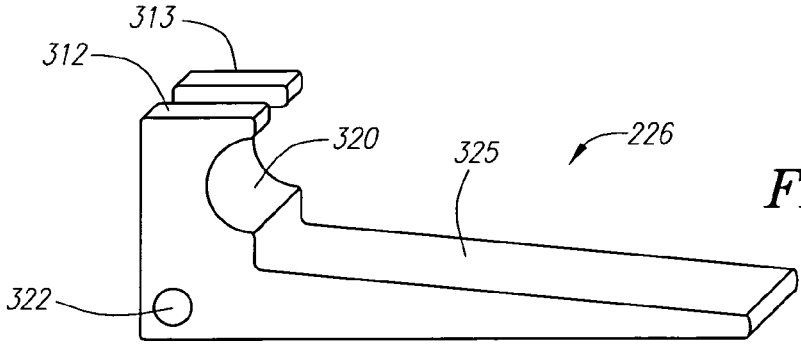
FIG. 3B is an oblique view diagram of the string receptor for a tension-adjustable string.

The operation illustrated in FIGS. 5A, 5B and 5C may be better understood by reference to the subject matter of FIGS. 3A and 3B, which illustrate further details of a preferred string receptor 226. FIG. 3B is an oblique view diagram of the string receptor 226, illustrating a pair of forked members 312, 313 which are formed in the shape of a semi-circular hollow 320 for receiving the knobbed or balled end 441 of a string 440 (as shown in, e.g., FIGS. 5A–5C). An elongated lever 325 extends rearwards from the forked members 312, 313. The string receptor 226 is preferably configured to pivot about a fulcrum point defined, in this example, by a cylindrical rod or axle 322 which is passed through a bored hole in the body of the string receptor 226. The string receptors 225 shown in FIGS. 2A and 2B for the non-tension-adjustable strings are similar to the string receptor 226 for a tension-adjustable string, but may be smaller in size with, e.g., a shorter lever portion 325 and shorter forked members 312, 313. FIG. 3A is a front view diagram comparing the approximate relative sizes, according to one example, of string receptors 225 and 226 for a tension-adjustable string and a non-tension-adjustable string, respectively. As will be further explained, the elongated lever 325 of the tension-adjustable string receptor 226 allows engagement of both a fine-tuning member (e.g., screw) and a tension adjusting member, as opposed to simply a fine-tuning member.

In the particular example of operation illustrated in FIGS. 5A–5C, the guitar body 102 has a small cutout portion 290 which facilitates movement of the elongated lever 325 of the string receptor 226. FIG. 7 is an illustration of a top-view of the tailpiece assembly 200, showing an example of a cutout portion 290 underneath the extension 205 portion of the tailpiece assembly 200. Alternatively, the tailpiece portion 200 may be raised from the surface of the body 102 of the guitar 100, potentially dispensing with the need for a cutout portion 290. Also, as further explained herein, the string receptor 226 may in certain embodiments be inverted, thereby also potentially dispensing with the need for a cutout portion 290.

Returning now to the operation illustrated in FIGS. 5A–5C, the "normal" playing position is represented by FIG. 5C, with the lever handle 208 (shown in phantom) in the depressed position. In the "normal" playing position, the fine tuning screw 220 is engaged with the elongated lever 325 of the string receptor 226. The fine tuning screw 220 may be rotated clockwise or counter-clockwise to increase or decrease the tension of the string 440 by causing the string receptor 226 to pivot downwards or upwards. The amount of tension that can be introduced to the string 440 is generally a function of, among other things, the depth and shape of the cutout portion 290 and the length of the screw 220. When the lever handle 208 is manually flipped to an upright or partially upright position, as illustrated in FIG. 5A, the fine tuning screw 220 disengages the elongated lever 325 of the string receptor 226, and the natural tension of the string 440 causes the string receptor to pivot upwards, finally coming to rest against the tension adjustment screw 216. Because the string receptor 226 pivots forward, the effective length of the string 440 is reduced, thus decreasing the tension on the string 440. FIG. 5B shows a transition between states of the string tension adjustment mechanism, illustrating the lever handle 208 partially raised, and fine tuning screw 220 partially retracted.

It will be appreciated that the amount by which the tension of the string 440 is reduced can be varied by adjustment of the tension adjustment screw 216. Rotation of the tension adjustment screw 216 in a clockwise or counter-clockwise direction varies the amount by which the string receptor 226 can pivot before being stopped by the tension adjustment screw 216. FIGS. 6A and 6B are additional cut-away side view diagrams illustrating examples of different adjustment positions of the tension adjustment screw 216. In FIG. 6A, the tension adjustment screw 216' is in a higher position than the tension adjustment screw 216" position illustrated in FIG. 6B. Accordingly, the string receptor 226 is able to pivot a greater distance in the example of FIG. 6B than it would be in the example of FIG. 6A, as illustrated by the comparisons of distance T1 in FIG. 6A and distance T2 in FIG. 6B. The fine tuning adjustment screw 220 and the tension adjustment screw 216 are preferably precision machined to, e.g., prevent slippage.

In the particular embodiment the operation of which is illustrated in FIGS. 5A–5C, the string tension adjustment mechanism may be configured such that rotation of the lever handle 208 results in a continuous rotational pivoting motion of the string receptor 226, and therefore a continuous increase or decrease in string tension without interruption. The angle between the fine tuning screw 220 and the elongated lever 325 of the string receptor 226 is preferably selected such that the fine tuning screw 220 continuously depresses the elongated lever 325 of the string receptor 226 without interruption when the lever handle 208 is lowered, and, likewise, allows a continuous rising of the elongated lever 325 without interruption when the lever handle 208 is raised. Among other things, this manner of operation prevents possible de-tuning of the string 440 by over-extension, and prevents the pitch of the string from temporarily increasing or decreasing beyond the desired target pitch as the mechanism is operated.

It will further be appreciated that the size and shape of lever handle 208 may facilitate operation of the string tension adjustment mechanism, particularly in live performances or musical renditions. Placement of the lever handle 208 in the depressed position for "normal" operation maintains the profile of the tailpiece assembly 200 as low as possible when adjustment of the string tension is not needed or desired, since dropping the pitch of a string with the string tension adjustment mechanism is expected to be a relatively infrequent event despite that it allows increased musical creativity and flexibility. Even when the lever handle 208 is flipped into an upright or semi-upright position, it is relatively unobtrusive. The enlarged fingerpad 209 of the lever handle 208, illustrated in FIGS. 2A and 2B, facilitates the manual operation of the tension adjustment mechanism during live performances and other renditions, allowing the lever handle 208 to be flipped quickly from one position to another. A longer lever handle 208 tends to require less force to move it and makes it more accessible, allowing single-finger or thumb activation during live performances or renditions. Also, because the tension adjustment screw 216 can be adjusted to a specific setting prior to a performance, the amount of drop in pitch can be calibrated with a very good degree of precision. The same amount of drop in pitch can be achieved each time the lever handle 208 is flipped to the upright or semi-upright position.

Where the fine tuning and string tension adjustment means of the string tension adjustment mechanism are embodied as adjustable screws, the screws may be relatively large in size to facilitate manual adjustment, either before or during performances. Because the fine tuning and string tension adjustment screws are large and relatively accessible, they may be adjusted in "real time" during playing.

While one or more particular examples of a string tension adjustment mechanism have been described above, various modified or altered variations of these embodiments may be constructed which nevertheless employ the same or similar principles. For example, in certain embodiments, a fine tuning adjustment means (such as fine tuning screw 220) may be omitted. In such a case, the lever-engaging structure provided by the fine tuning screw 220 would essentially revert to a mere fixed extension of the lever handle 208. Moreover, in other embodiments, other adjustable means besides screws may be used for fine tuning and/or string tension adjustment. Advantages to using screws to adjust the fine tuning and/or string tension are that they provide a continuous spectrum of adjustment positions and are fairly stable.

In other embodiments, the tension adjustment mechanism may be associated with more than one string, such that movement of the lever handle 208 results in a simultaneous change in tension of multiple strings. For example, the tailpiece assembly 200 may be constructed with another one or more pivoting string receptors, such as illustrated in FIG. 3B, each configured to engage a balled or knobbed end of a different string of the musical instrument, and each having an elongate arm as illustrated in FIG. 3B. The tailpiece assembly 200 may further include another one or more string tension adjustment screws, one for each of the additional strings to be affected. Then, placement of the lever handle 208 in the first (i.e., flat or horizontal) position causes an increased tension on each of the affected strings, while placement of the handle in the second (i.e., upright or semi-upright) position causes decreased tension on each of the affected strings, with the elongate arm of each pivoting string receptor coming to rest against each string's respective tension adjustment screw.

Alternatively, a tailpiece assembly may comprise multiple tension adjustment mechanisms, each with individual lever handles or other actuation mechanisms, to allow individual real-time adjustment of the tension of different strings.

In yet another alternative embodiment, the hinged string receptor (such as 226 illustrated in FIGS. 2A and 2B) may be inverted, such that the hinge or fulcrum point is positioned above the forked or hooked post which engages the knobbed or balled end of the string 140. In this embodiment, the elongate arm (e.g., 325) of the hinged string receptor may swing upwards instead of downwards, thus potentially dispensing with the cutout in the guitar body 102. The adjustable stops and pivotable lever arm in such a case would generally be re-positioned and/or modified in order to accommodate the upwards motion of the elongate arm of the hinged string receptor.

Figure 8:
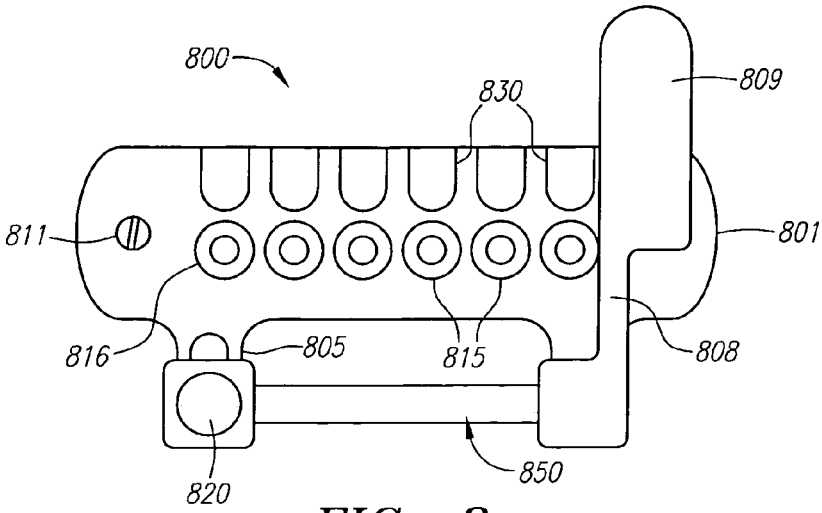
FIG. 8 is a diagram of an alternative embodiment of an assembly including a string tension adjustment mechanism.
Figure 9A:
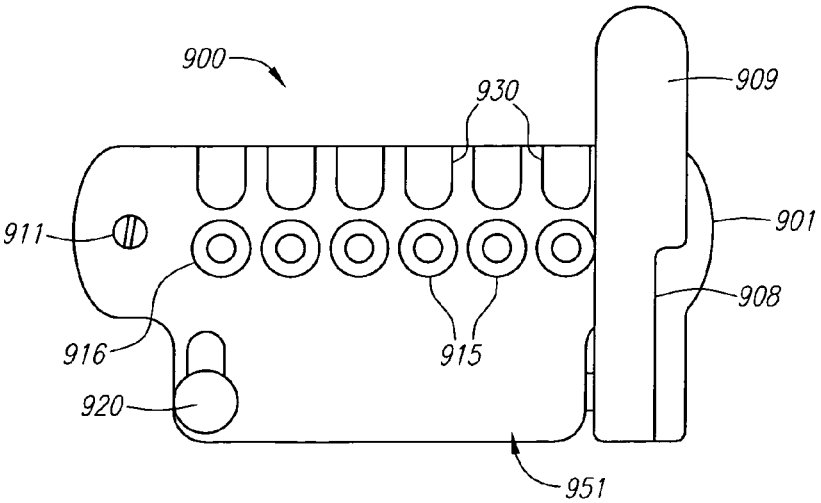
FIGS. 9A and 9B are diagrams of another alternative embodiment of an assembly including a string tension adjustment mechanism.
Figure 9B:
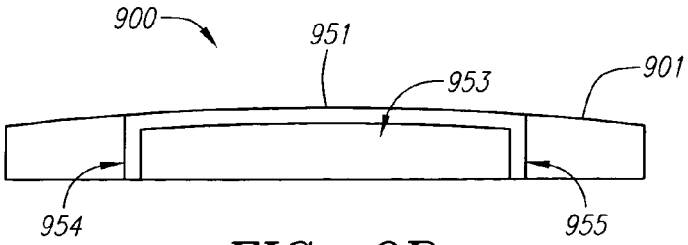

FIGS. 8, 9A and 9B are diagrams illustrating various alternative embodiments of an assembly including a string tension adjustment mechanism. The diagrams of FIGS. 8, 9A and 9B are slightly more abstract than those of, e.g., FIGS. 2A and 2B, and omit certain details not deemed necessary to the illustrations. The embodiments shown in FIGS. 8, 9A and 9B operate according to similar principles described previously with respect to the embodiment of FIGS. 2A and 2B, but have lever handle of the string tension adjustment mechanism placed further from the affected string receptor.

In more detail, with reference first to FIG. 8, a tailpiece assembly 800, similar to the tailpiece assembly 200 of FIGS. 2A and 2B, includes a body portion 801 having a plurality of cut-outs 830 for receiving the knobbed or balled ends of the individual strings (e.g., strings 140 shown in FIG. 1). In each of cut-outs 830 resides a string receptor (not explicitly shown) which, as previously described, may each generally comprise a hooked or forked member for engaging the knobbed or balled end of a string 140. The string receptors are preferably adjustable and may, for example, be hinged to allow fine tuning adjustment in conjunction with an adjustable stop (such as a screw), with the string tension providing the counter-force to the adjustable stop. The string receptors may be embodied as shown in and described previously with respect to FIGS. 3A and 3B. A set of fine-tuning screws 815 (and/or 820), one for each string 140, may be provided in order to allow fine tuning of the individual strings 140.

As further illustrated in FIG. 8, the tailpiece assembly 800 may have an extension 805 which is configured in part to enclose and/or provide structure for a string tension adjustment mechanism. In the present example, the extension 805 is associated with what would conventionally be the "low-E" string of a 6-string guitar, but it may alternatively be used in connection with the "high-E" string, or any other string, of the instrument. Similar to the embodiment shown in FIGS. 2A and 2B, the extension 805 comprises a pair of sidewalls. The fine tuning screw 820 is, as before, mechanically engaged with a rotatable cylindrical rod 850, but in contrast to the embodiment illustrated in FIGS. 2A and 2B the cylindrical rod 850 extends along the breadth of the backside of the body portion 801. The cylindrical rod 850 is attached to a lever handle 808 which is located on the opposite side of the tailpiece assembly 800, as illustrated in FIG. 8. In the instant example, the lever handle 808 varies in size and shape somewhat from the lever handle 208 illustrated in FIGS. 2A and 2B, but it may take a variety of different sizes of shapes, depending upon the preferences for the overall design. Similar to the lever handle 208, the lever handle 808 in FIG. 8 has an arm terminating in an enlarged finger pad 809. Placement of the lever handle 809 at the opposite end of the tailpiece assembly 800 may facilitate manual operation of the lever handle 809. For example, movement of the lever handle 809 may be readily accomplished with, e.g., the fourth and/or fifth fingers, with minimal interruption to the musician's playing of other strings of the instrument.

In the example of FIG. 8, as with that of FIGS. 2A and 2B, the tension adjustment screw 816 is lined up in generally along the same axis as the fine-tuning screws 815 for the non-tension-adjustable strings. The tension adjustment screw 816 may, but need not, be longer than the fine-tuning screws 815 used on the non-tension-adjustable strings, in order to increase accessibility in certain embodiments. The fine tuning screw 820 for the tension-adjustable string serves a similar purpose to the other fine tuning screws 815, but is placed further back therefrom to provide room for the tension adjustment screw 816. The rotatable cylindrical rod 850 preferably has a threaded hole bored through its mid-section, between the sidewalls of the extension 805 to the tailpiece assembly 800, through which the fine tuning screw 820 is placed to provide mechanical engagement.

FIGS. 9A and 9B illustrate a variation of the embodiment shown in FIG. 8, wherein the extended cylindrical rod-850 is covered by an extended cover plate 951 which is part of the tailpiece assembly 900 (thus the extended cylindrical rod is not visible in the illustration of FIGS. 9A and 9B). Beneath the cover plate 951 may be a hollow region 953, as illustrated in FIG. 9B, with a pair of sidewalls 954, 955 supporting the cover plate 951. FIG. 9A also illustrates another slight variation of the size and shape of the lever handle 908 used to actuate the string tension adjustment mechanism. In other respects, however, the embodiment shown in FIGS. 9A and 9B functions similar to the embodiment illustrated in FIG. 8.

According to one or more embodiments as disclosed herein, in one aspect, a hinged string receptor includes a post and an elongate lever arm pivotally mounted to tailpiece (or combined bridge/tailpiece) frame. The elongate lever arm can be depressed into a cutout beneath plane of the instrument surface. A pivotable lever handle controls motion of the hinged string receptor by either causing a first adjustable stop (e.g., a first adjustable screw) to engage the elongate lever arm (thus depressing it), resulting in increased string tension, or else causing the first adjustable stop to disengage, thereby allowing the elongate lever arm to be raised by the natural tension of the string and allowing it to come to rest against a second adjustable stop (e.g., a second adjustable screw), resulting in decreased string tension. The first adjustable stop controls the normal playing pitch (and fine tuning), and the second adjustable stop controls the drop-down pitch.

While various embodiments described herein have generally been discussed in terms of dropping down pitch by decreasing string tension, alternatively such embodiments may be viewed, and utilized, as a tension increasing mechanism, wherein the normal playing pitch is the lower pitch, and the string tension adjustment mechanism is activated to occasionally increase string tension on demand. Also, while embodiments shown herein generally are discussed with reference to guitars, the same principles may apply to other stringed instruments as well that may benefit from a string tension adjustment mechanism. Moreover, the principles and embodiments described herein are equally applicable to right-handed and left-handed guitars and other stringed instruments, with the tailpiece assembly and string tension adjustment mechanisms capable of, e.g., being constructed in mirror-image to support opposite handed guitars or other stringed instruments.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. An apparatus for adjusting the tension of at least one string of a stringed musical instrument, comprising:

a pivoting member configured to engage an end of a string and comprising an elongate arm;

an adjustable stop; and a handle adapted for manual actuation and having a contact member normally disengaged from the elongate arm;

wherein placement of the handle in a first stationary position causes the contact member to engage and depress the elongate arm of the pivoting member, thereby increasing tension on the string, and wherein placement of the handle in a second stationary position causes the contact member to disengage the elongate arm of the pivoting member, thereby allowing the pivoting member to come to rest against the adjustable stop and decreasing tension on the string.

2. The apparatus of claim 1, wherein said adjustable stop comprises an adjustable screw.

3. The apparatus of claim 1, wherein said pivoting member is affixed to a tailpiece, and wherein said tailpiece is adapted to anchor a plurality of strings of the stringed musical instrument.

4. The apparatus of claim 1, wherein the elongate arm of said pivoting member is adapted to be depressed beneath a surface plane of the stringed musical instrument when the handle is placed in said first position.

5. The apparatus of claim 1, wherein said contact member comprises a fine tuning adjustment mechanism.

6. The apparatus of claim 5, wherein said contact member comprises an adjustable screw for fine tuning the string when the handle is placed in said first position.

7. The apparatus of claim 1, wherein said pivoting member comprises a post for securely receiving the end of the string, and wherein said post and the elongate arm of said pivoting member join at a fulcrum position of the pivoting member.

8. An apparatus for adjusting the tension of at least one string of a stringed musical instrument, comprising:

a pivoting member configured to engage an end of a string and comprising an elongate arm;

an adjustable stop; and a handle adapted for manual actuation;

wherein placement of the handle in a first position causes a contact member to engage and depress the elongate arm of the pivoting member, thereby increasing tension on the string, and wherein placement of the handle in a second position causes the contact member to disengage the elongate arm of the pivoting member, thereby allowing the pivoting member to come to rest against the adjustable stop and decreasing tension on the string;

wherein said tailpiece comprises a plurality of string receptors substantially serially aligned between a first end and a second end of said tailpiece;

wherein said handle is secured proximate to the first end of said tailpiece;

wherein said contact member is secured proximate to the second end of said tailpiece; and wherein said handle is mechanically engaged with said contact member via a rod extending substantially from the first end of said tailpiece to the second end of said tailpiece.

9. An apparatus for adjusting the tension of at least one string of a stringed musical instrument, comprising:

a pivoting member configured to engage an end of a string and comprising an elongate arm;

an adjustable stop; and a handle adapted for manual actuation;

wherein placement of the handle in a first position causes a contact member to engage and depress the elongate arm of the pivoting member, thereby increasing tension on the string, and wherein placement of the handle in a second position causes the contact member to disengage the elongate arm of the pivoting member, thereby allowing the pivoting member to come to rest against the adjustable stop and decreasing tension on the string; and wherein said stringed musical instrument is a guitar, and wherein said handle comprises a second elongate arm mechanically engaged with said contact member at one end and terminating in an enlarged fingerpad portion at another end, said second elongate arm of sufficient length to be manually actuatable without the musician interrupting play.

10. An apparatus for adjusting the tension of at least one string of a stringed musical instrument, comprising:

a pivoting member configured to engage an end of a string and comprising an elongate arm;

an adjustable stop; and a handle adapted for manual actuation;

wherein placement of the handle in a first position causes a contact member to engage and depress the elongate arm of the pivoting member, thereby increasing tension on the string, and wherein placement of the handle in a second position causes the contact member to disengage the elongate arm of the pivoting member, thereby allowing the pivoting member to come to rest against the adjustable stop and decreasing tension on the string; and wherein said handle has only two stationary positions, and wherein said handle is actuated by manually rotating the handle in a downward direction to place said handle in the first stationary position, and manually rotating said handle in an upward direction to place said handle in the second stationary position.

11. The apparatus of claim 10, wherein said handle lies substantially parallel with a primary surface plane of the musical instrument when placed in the first stationary position, and wherein said handle is upright or semi-upright with respect to the primary surface plane of said musical instrument when placed in the second stationary position.

12. An apparatus for adjusting the tension of at least one string of a stringed musical instrument, comprising:

a pivoting member configured to engage an end of a string and comprising an elongate arm;

an adjustable stop; and a handle adapted for manual actuation;

wherein placement of the handle in a first position causes a contact member to engage and depress the elongate arm of the pivoting member, thereby increasing tension on the string, and wherein placement of the handle in a second position causes the contact member to disengage the elongate arm of the pivoting member, thereby allowing the pivoting member to come to rest against the adjustable stop and decreasing tension on the string;

another one or more pivoting members each configured to engage an end of a different string of the musical instrument and each comprising an elongate arm; and another one or more adjustable stops, one for each of said different strings;

wherein placement of the handle in the first position causes an increased tension on each of said different strings, and wherein placement of the handle in the second position causes decreased tension on each of said different strings with the elongate arm of each pivoting member coming to rest against each string's respective adjustable stop.

13. A tailpiece assembly for a stringed musical instrument, comprising:

a tailpiece frame;

a pivotable string receptor affixed to a portion of the tailpiece frame, the pivotable string receptor comprising a post to securely engage an end of a string and an elongate arm joined to said post, said pivotable string receptor having a fulcrum proximate to where said post and said elongate arm join;

an adjustable stop affixed to said tailpiece frame; and a lever handle adapted for manual actuation, said lever handle mechanically joined with a contact member adapted to engage and disengage the elongate arm of said pivotable string receptor;

wherein placement of the handle in a first position causes the contact member to engage and depress the elongate arm of said pivotable string receptor, thereby increasing tension on the string, and wherein placement of the handle in a second position causes the contact member to disengage the elongate arm of said pivotable string receptor, thereby allowing the elongate arm to come to rest against the adjustable stop and decreasing tension on the string.

14. The tailpiece assembly of claim 13, wherein said adjustable stop comprises an adjustable screw rotatable through a threaded hole in said tailpiece frame.

15. The tailpiece assembly of claim 13, further comprising a plurality of additional string receptors adapted to anchor a plurality of additional strings of the stringed musical instrument.

16. The tailpiece assembly of claim 15, wherein said additional string receptors are substantially serially aligned between a first end and a second end of the tailpiece assembly, and wherein said lever handle is mechanically joined to said contact member via a rod spanning across a breadth of one or more of said additional string receptors.

17. The tailpiece assembly of claim 13, wherein the elongate arm of said pivotable string receptor is adapted to be depressed beneath a surface plane of the stringed musical instrument when said lever handle is placed in the first position.

18. The tailpiece assembly of claim 13, wherein said contact member comprises an adjustable screw for fine tuning the string when said lever handle is placed in the first position.

19. The tailpiece assembly of claim 13, wherein said lever handle comprises a second elongate arm terminating in an enlarged fingerpad portion, said second elongate arm of sufficient length to be manually actuatable without the musician interrupting play.

20. The tailpiece assembly of claim 13, wherein said lever handle lies substantially flat when placed in the first position, and wherein said lever handle is upright or semi-upright when placed in the second position.

21. The tailpiece assembly of claim 13, wherein said contact member engages and disengages the elongate arm of said pivotable string receptor in a manner such that the elongate arm is continuously forcibly depressed without interruption when the contact member is applied to a top surface of the elongate arm during actuation of the lever handle in one direction, and the elongate arm continuously rises without interruption when released by the contact member during actuation of the lever handle in the opposite direction.

22. A tailpiece apparatus for a stringed musical instrument having a body portion with a top surface, comprising:

a tailpiece frame adapted to be secured to the top surface of the body portion of the musical instrument, said tailpiece frame adapted to engage a plurality of strings;

a hinged lever having a post for engaging a first end of a string and having a lever arm mechanically joined with the post, said lever arm adapted to be depressed below a plane of the top surface of the body portion of the musical instrument;

an adjustable stop;

a contact member; and a pivoting lever handle actuatable between a first position and a second position;

wherein placement of the pivoting lever handle in the first position causes the contact member to engage and depress the lever arm of the hinged lever, thereby increasing tension on the string, and wherein placement of the pivoting lever handle in the second position causes the contact member to disengage the lever arm of the hinged lever, thereby decreasing tension on the string and allowing the hinged lever to pivot until coming to rest against the adjustable stop.

23. The tailpiece apparatus of claim 22, wherein said adjustable stop comprises an adjustable screw residing in a threaded hole in said tailpiece frame, said adjustable screw controlling a drop down pitch of the string.

24. The tailpiece apparatus of claim 23, wherein said contact member comprises a second adjustable screw, said second adjustable screw controlling fine tuning of the string when the pivoting lever handle is in the first position.

25. The tailpiece apparatus of claim 22, wherein said pivoting lever handle terminates in an enlarged fingerpad area.

26. An apparatus for fine tuning and for rapidly adjusting the tension of at least one string of a stringed musical instrument, comprising:

a tailpiece frame;

a pivoting string receptor configured to engage an end of a string and comprising an elongate arm;

a first adjustable stop affixed to said tailpiece frame;

a second adjustable stop adapted to engage and disengage the elongate arm of said pivoting string receptor;

a handle adapted for rapid manual actuation, said handle mechanically engaged with said second adjustable stop;

wherein placement of the handle in a first position causes the second adjustable stop to engage and depress the elongate arm of the pivoting string receptor, thereby increasing tension on the string, and wherein placement of the handle in a second position causes the second adjustable stop to disengage the elongate arm of the pivoting string receptor, thereby allowing the pivoting string receptor to come to rest against the first adjustable stop and decreasing tension on the string.

27. The apparatus of claim 26, wherein the second adjustable stop dictates a normal playing pitch for the string, and wherein the first adjustable stop dictates a drop down pitch for the string.

28. The apparatus of claim 26, wherein said first adjustable stop and said second adjustable stop each comprise an adjustable screw having a head portion substantially wider than a threaded body portion and readily accessible for direct manual adjustment, said threaded portion facing towards the surface of the musical instrument.

* * * * *